US006253945B1

(12) United States Patent
Lee

(10) Patent No.: US 6,253,945 B1
(45) Date of Patent: Jul. 3, 2001

(54) CONTAINER HAVING SEPARABLE LIQUID-ORNAMENT UNIT

(76) Inventor: Vincent Kuo Wei Lee, No. 42, Lane 458, Sheh Chung Street, Taipei (TW)

( * ) Notice: Subject to any disclaimer, the term of this patent is extended or adjusted under 35 U.S.C. 154(b) by 0 days.

(21) Appl. No.: 09/390,639

(22) Filed: Sep. 7, 1999

(51) Int. Cl.[7] ..... B65D 6/00
(52) U.S. Cl. ..... 220/23.86
(58) Field of Search ..... 220/23.86, 23.83, 220/23.6, 23.4

(56) References Cited

U.S. PATENT DOCUMENTS 3,658,204 * 4/1972 Bottger ..... 220/23.86
3,887,069 * 6/1975 Diwo ..... 220/23.86
5,180,079 * 1/1993 Jeng ..... 220/23.86
5,318,787 * 6/1994 Brauner et al. ..... 220/23.86
5,674,546 * 10/1997 Barnes et al. ..... 220/23.86
5,743,423 * 4/1998 Franco ..... 220/23.86
5,960,984 * 10/1999 Weston ..... 220/23.86
6,085,919 * 7/2000 Singer ..... 220/23.86

* cited by examiner

*Primary Examiner*—Joseph M. Moy
(74) *Attorney, Agent, or Firm*—Dougherty & Troxell

(57) ABSTRACT

A container including independent main container unit and liquid-ornament unit that are separably connected to each other. The main container unit is formed by blow molding and can therefore have diversified configurations. Retaining means, such as collar and protruded key, and an open space may be formed outside the main container unit at the time the latter is formed. The liquid-ornament container has a configuration corresponding to the open space and can therefore be easily assembled to the main container unit by fitting it into the open space and holding it in place with the collar and key.

2 Claims, 6 Drawing Sheets

CONTAINER HAVING SEPARABLE LIQUID-ORNAMENT UNIT

BACKGROUND OF THE INVENTION

The present invention relates to a container having a main container unit and a separable liquid-ornament unit. The main container unit of the container is formed by blow molding and can therefore have diversified configurations. An open space and retaining means can be formed outside the main container unit, so that the liquid-ornament unit may be easily firmly fitted in the open space and thereby connected to the main container unit.

There is a container with a liquid ornament attached thereto being widely welcomed in the markets. Such container includes multiple injection-molded parts that are connected to one another to form a complete container through ultrasonic welding. One of the multiple parts is a chamber filled with oil and water before the chamber is sealed. Following are some disadvantages of such container in respect to its design and manufacturing process:

1. All the parts of the container are injection molded. Since there are many limitations in making the injection molds, such as the way of knocking out, these parts may have only limited types of shape. That is, the container could not be diversified designed to create changeful appearances.
2. Although it has been tried to give the container a shape as simple as possible to reduce ultrasonic welding, the ultrasonic welding are still required and the filling of dual-liquid ornament into one of the parts is time-consuming. All these factors adversely increase the manufacturing cost of the container and decrease the competition ability thereof in the markets.

It is therefore desirable to develop an improved liquid-ornament contained container to eliminate the above-mentioned disadvantages.

SUMMARY OF THE INVENTION

A primary object of the present invention is to provide a container includes independent main container unit and liquid-ornament unit that are separably connected to each other. The main container unit is formed by blow molding and can therefore have diversified configurations. Retaining means, such as collar and protruded key, and an open space may be formed outside the main container unit at the time the latter is formed. The liquid-ornament container has a configuration corresponding to the open space and can therefore be easily assembled to the main container unit by fitting it into the open space and holding it in place with the collar and key.

DETAILED DESCRIPTION OF THE PREFERRED EMBODIMENTS

Figure 1:
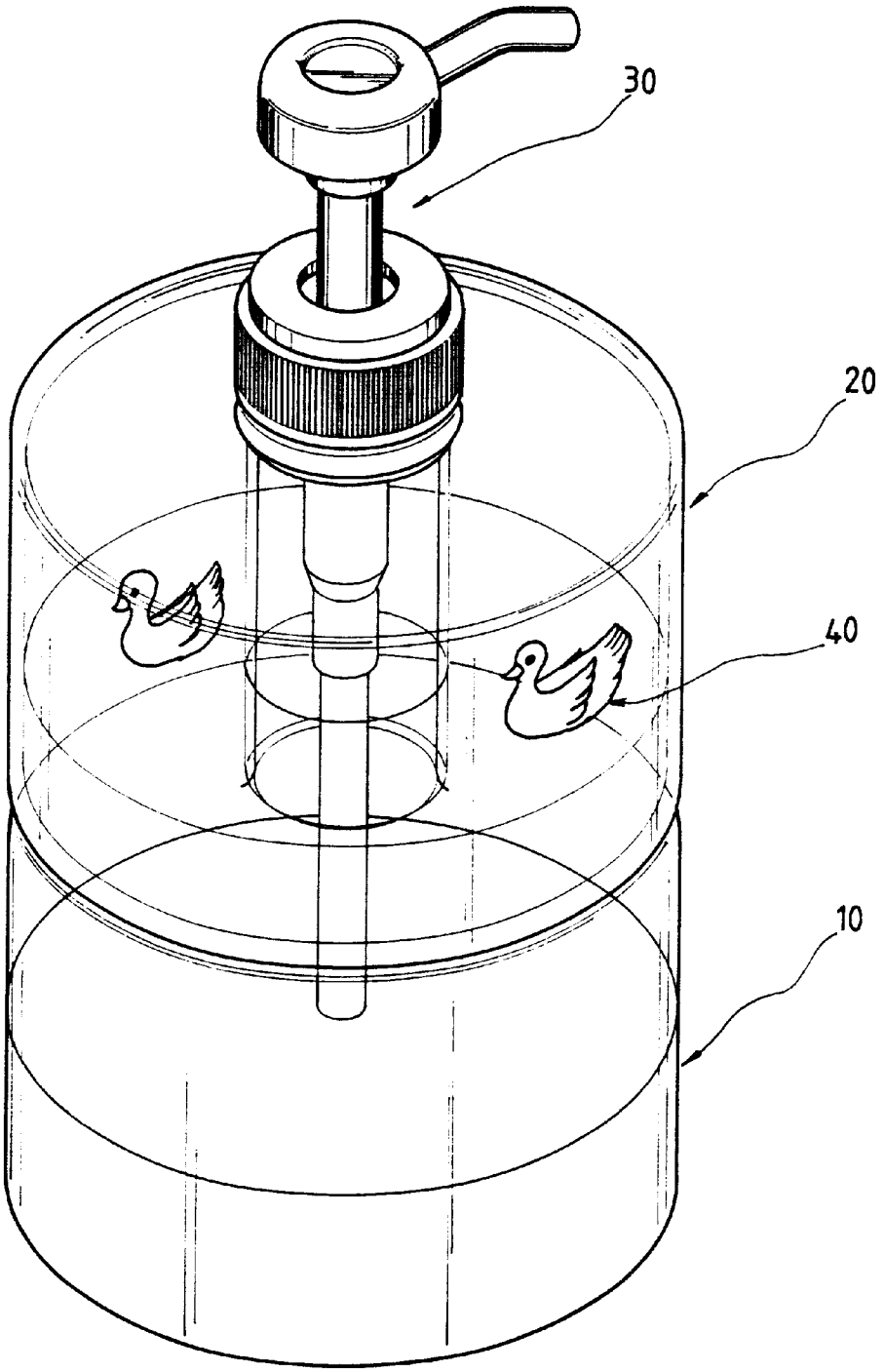
FIG. 1 is an assembled perspective of a container having separable liquid-ornament unit according to a first embodiment of the present invention.
Figure 2:
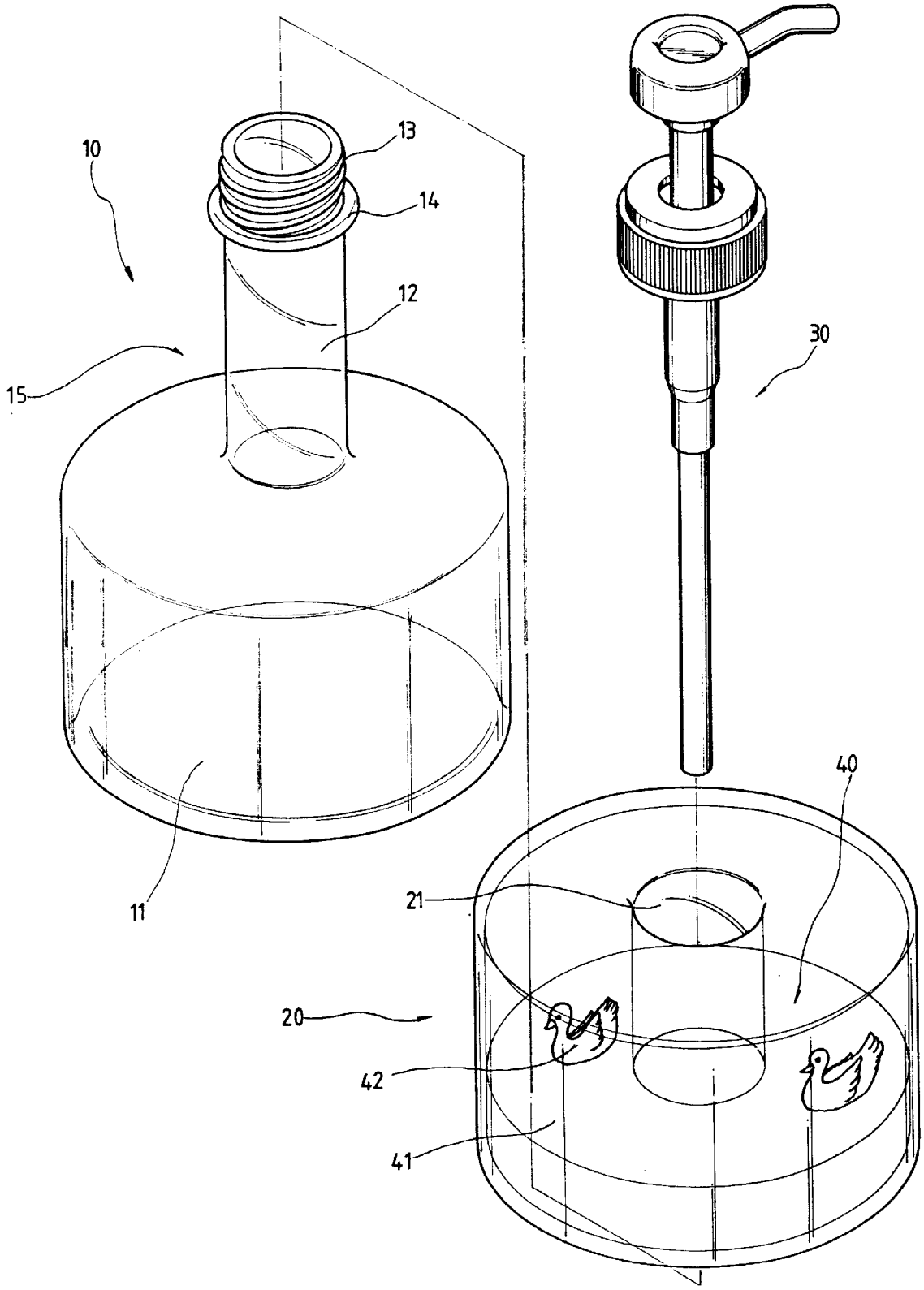
FIG. 2 is an exploded perspective of the container of FIG. 1.
Figure 3:
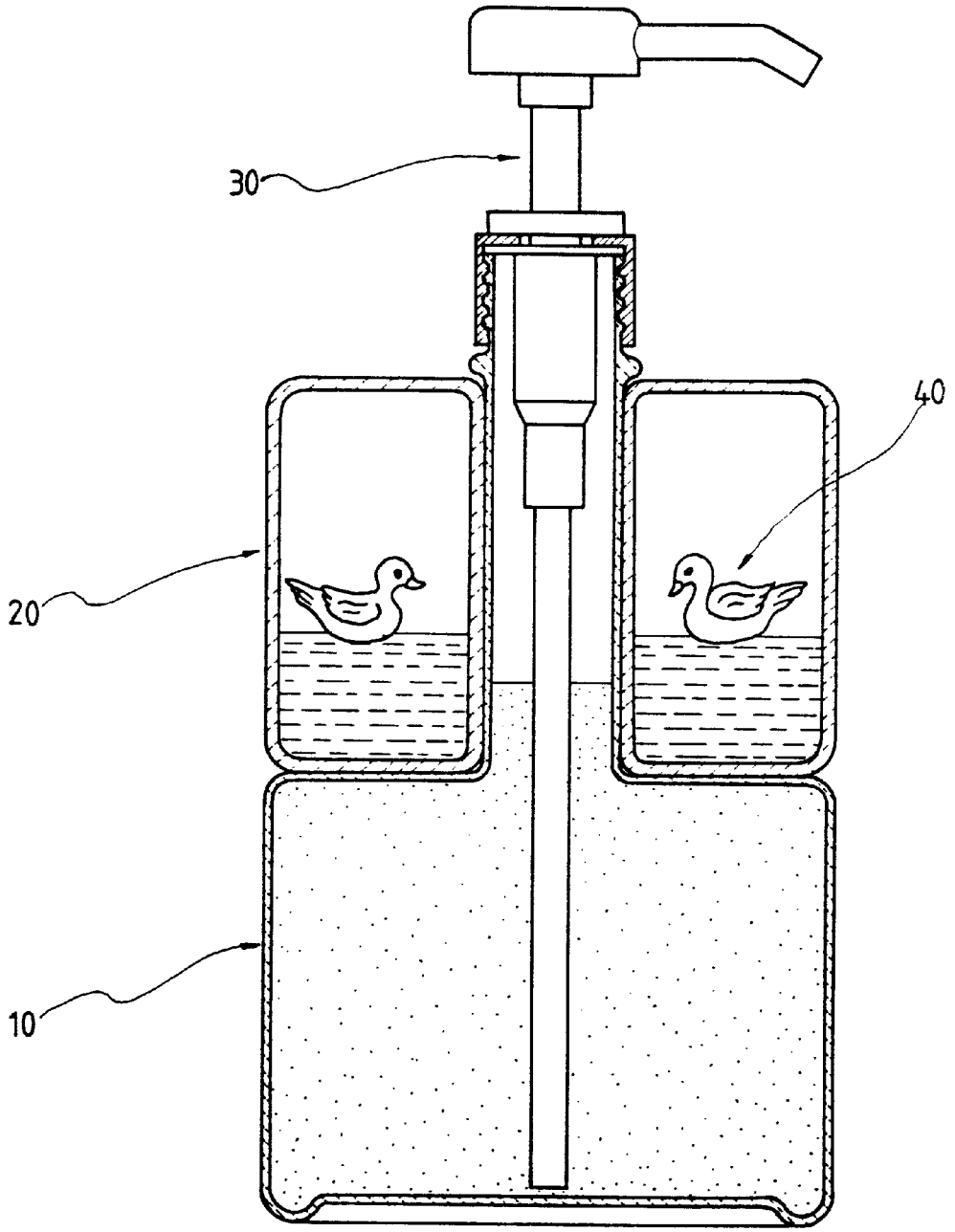
FIG. 3 is a side sectional view of the container of FIG. 1.

Please refer to FIGS. 1, 2 and 3 that are sequentially an assembled perspective, an exploded perspective, and a side sectional view of a container having separable liquid-ornament unit according to a first embodiment of the present invention. The container mainly includes a main container unit 10, a liquid-ornament unit 20, and an associated dispenser 30.

The main container unit 10 is made of a plastic material. Unlike the conventional similar containers, such as that disclosed in the Taiwan Patent Application No. 87210180 entitled "A Container Structure", that have both the main container unit and the ornamental unit formed by injection molding, the main container unit of the present invention is formed by blow molding. With this blow-molding manner, the main container unit 10 can be more easily formed while there are diversified shapes available for it. For example, the container of FIGS. 1, 2 and 3 has a main container unit 10 defining a considerably large chamber 11 for accommodating a planned type of product, such as a creamy liquid. The main container unit 10 has a centered and upward extended tubular neck 12. An upper end of the tubular neck 12 has integrally formed external threads 13 and a collar 14 that serves as a retaining means. A space 15 surrounding a portion of the tubular neck 12 between the collar 14 and the chamber 11 provides a location for holding the liquid-ornament unit 20.

The liquid-ornament unit 20 is a separately formed clear container for accommodating a desired liquid ornament 40 therein. The liquid ornament 40 shown in the container of FIGS. 1, 2 and 3 includes a dual-liquid (oil and water) 41 and three-dimensional floating ornaments 42. In order to hold the dual-liquid 41 and the floating ornaments 42, the liquid-ornament unit 20 is preferably formed by injection molding of general plastic material. The liquid-ornament unit 20 may have a configuration selected depending on the space 15. In the embodiment shown in FIGS. 1, 2 and 3, the liquid-ornament unit 20 is an annular container defining a central through hole 21. The central through hole 21 has an inner diameter slightly larger than an outer diameter of the tubular neck 12 but slightly smaller than an outer diameter of the collar 14. By taking advantage of inherent rigidity and elasticity of the molded plastic main container unit 10, the liquid-ornament unit 20 is allowed to put around the tubular neck 12 from the threads 13 at the upper end of the tubular neck 12, and eventually locate in the space 15 immediately above the main container unit 10. By this manner, the main container unit 10 and the liquid-ornament unit 20 are combined to form a two-chamber container having a shape intended by a designer. With the tubular neck 12 extending through the central hole 21 and the collar 14 abutting against an upper opening of the central hole 21, the liquid-ornament unit 20, once it has been forced down from the upper end of the neck 12 to pass the collar 14, would not be easily separated from the main container unit 10. The associated dispenser 30, such as a set of press-type suction head and pipe, can be then mounted onto the upper end of the tubular neck 12 by engaging with the threads 13 to complete the container of the present invention.

Before the liquid-ornament unit 20 is assembled to the main container unit 10 around the tubular neck 12, it is easy to access the tubular neck 12. Therefore, an outer surface of the tubular neck 12 can be freely printed or labeled with any desired design. Such design will be advantageously magnified by and clearly viewed through liquid in the liquid-ornament unit 20 mounted around the tubular neck 12. The design on the tubular neck 12 also serves as a very good background for the floating ornaments 42 in the dual liquid 41.

The main container unit 10 may have changeful shapes. And the tubular neck 12, the threads 13 and the collar 14 may also be formed differently. Another three embodiments of the container of the present invention will now be described below.

Figure 4:
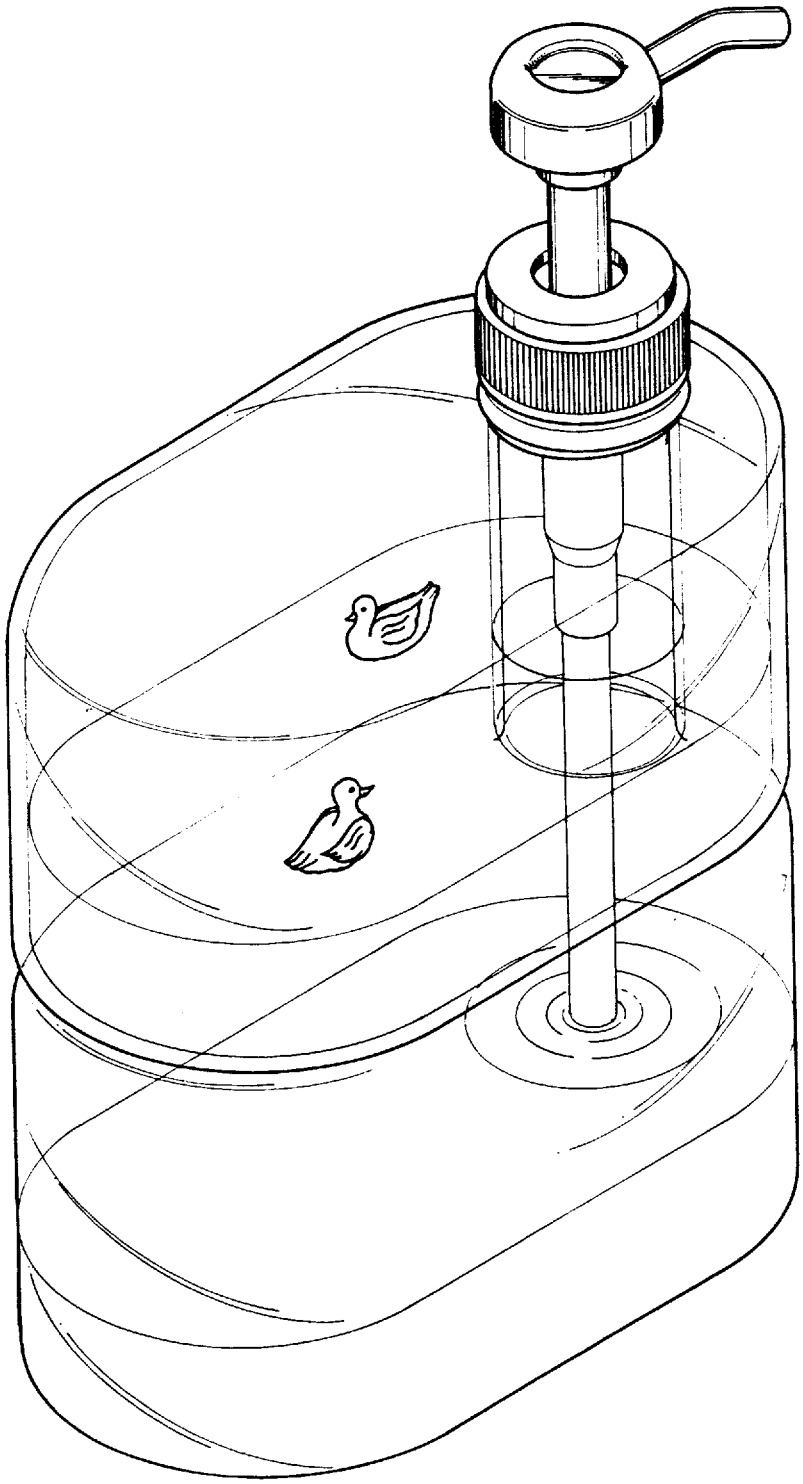
FIG. 4 is a perspective of a container having separable liquid-ornament unit according to a second embodiment of the present invention.

FIG. 4 illustrates a second embodiment of the present invention. In this embodiment, a container 50 is structurally similar to the container in the first embodiment and consists of a main container unit 51, a liquid-ornament unit 52, and an associated dispenser 53. However, the main container unit 51 and the liquid-ornament unit 52 are not limited to regular round bottles, and the main container unit 51 has a tubular neck eccentrically upward projected from a top thereof.

Figure 5:
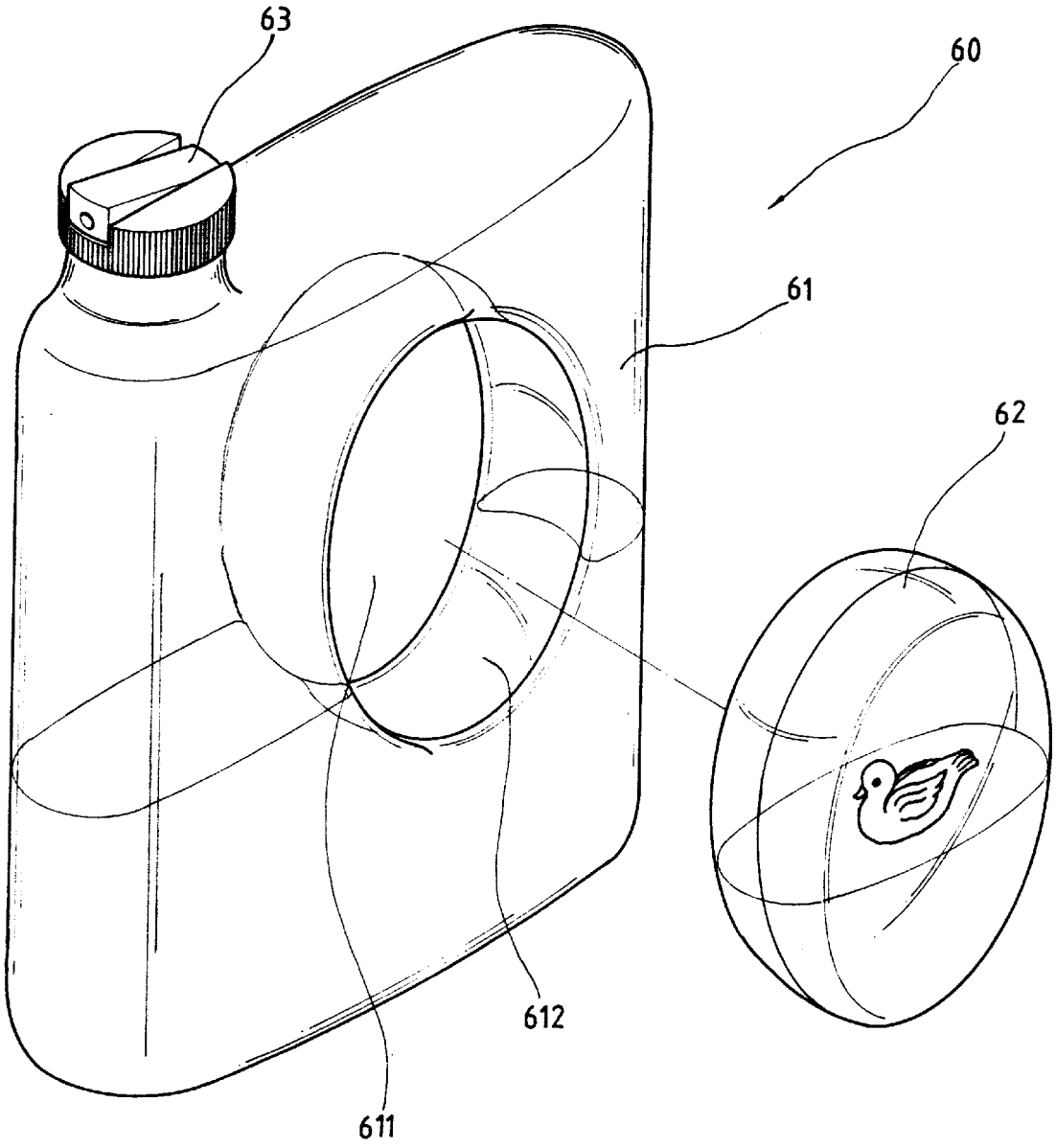
FIG. 5 is a partially exploded perspective of a container having separable liquid-ornament unit according to a third embodiment of the present invention.

FIG. 5 illustrates a third embodiment of the present invention. In this embodiment, a container 60 also consists of a main container unit 61, a liquid-ornament unit 62, and an associated dispenser 63. Wherein, the main container unit 61 provides an independent open space 611 generally located at a central portion of the main container unit 61 for holding the liquid-ornament unit 62 therein. A recess 612 extending along an inner peripheral wall of the space 611 forms a retaining means to hold the liquid-ornament unit 62 in place in the space 611. Meanwhile, the liquid-ornament unit 62 is designed to have a configuration corresponding to the space 611 and the retaining means 612, so that the liquid-ornament unit 62 can be set in the space 611 without the risk of easily separating from the space 611. In this third embodiment, a press-type dispensing head is selected to serve as the associated dispenser 63. To match with the dispensing head 63, the main container unit 61 has a differently formed upper opening. The dispensing head 63 may be any suitable product available in the markets, so long as it matches with the upper opening of the main container unit 61 to provide the function of dispensing creamy liquid from the container 60.

Figure 6:
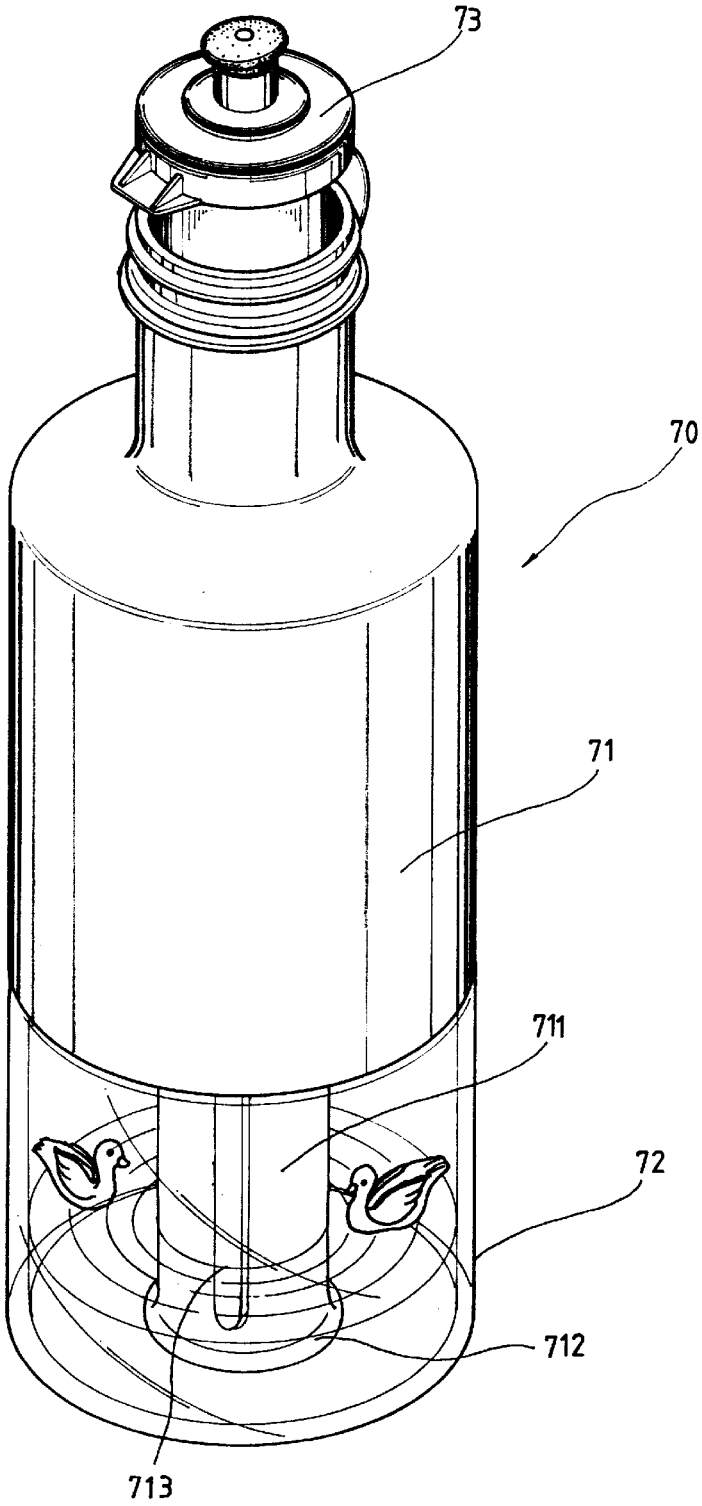
FIG. 6 is a perspective of a container having separable liquid-ornament unit according to a fourth embodiment of the present invention.

FIG. 6 illustrates a fourth embodiment of the present invention that is a container 70 consisting of a main container unit 71, a liquid-ornament unit 72, and an associated dispenser 73. The main container unit 71 is in a shape of general plastic beverage container designed for sportsmen. The associated dispenser 73 is also a generally available product. In this fourth embodiment, the main container unit 71 has a tubular leg 711 downward extending from a bottom of the main container unit 71. A collar 712 is provided around a lower end of the tubular leg 711 to serve as a retaining means. The liquid-ornament unit 72 defines a central through hole having a diameter suitable for the unit 72 to mount around the tubular leg 711 and be retained thereto below the main container unit 71 by the collar 712. Thereby, the liquid-ornament unit 72 forms a decoration at a lower part of the container 71. For the liquid-ornament unit 72 to be more stably located around the tubular leg 711, a longitudinally extended key 713 may be additionally provided to protrude from an outer surface of the tubular leg 711 to engage with a recess correspondingly formed on an outer surface of the central through hole of the liquid-ornament unit 72. Both the collar 712 and the key 713 could be integrally formed during blow molding of the main container unit 71. Again, the tubular leg 711 may be printed or labeled on its outer surface with desired designs or advertisements.

In conclusion, the present invention provides a container having a main container unit and a separable liquid-ornament unit. The main container unit is formed by blow molding and can therefore have more choices in its configuration. That is, the liquid-ornament unit may be assembled to the main container unit at different positions and have different configurations depending on the shape of the main container unit and the position at which it is located on the main container unit. Moreover, the main container unit and the liquid-ornament unit can be easily combined to form a complete container having a desired shape. Therefore, the container of the present invention is superior to conventional containers both in its structure and the ornamental effect it can provide.

What is claimed is:

1. A container comprising a main container unit and a smaller liquid-ornament unit separately assembled to said main container unit, said main container unit being formed by blow molding to have a configuration defining a base portion and an upwardly extending tubular neck having an outside diameter and an upper end portion including integrally formed external threads and retaining means having an outside diameter formed on said upper end portion below said external threads, said main container portion defining an open space around said upwardly extending tubular neck and between said base portion and said retaining means and said liquid ornament unit defining a through passageway having an inner diameter slightly larger than said outside diameter of said upwardly extending tubular neck and slightly smaller than the diameter of said retaining means and a configuration for fitting into said open space with said liquid ornament unit adjacent to and resting on said base portion of said main container unit and with said upwardly extending neck portion extending through and beyond said passageway and held in place by said retaining means and wherein said liquid-ornament unit can be directly assembled on said main container unit by fitting it over said tubular neck and into said open space from outside of said main container unit.

2. A container according to claim 1 which includes a liquid dispenser threaded onto said external threads above said retaining means and a dual liquid and a floating ornament within said liquid ornament unit.

* * * * *